US007693447B2

(12) United States Patent
Lee et al.

(10) Patent No.: US 7,693,447 B2
(45) Date of Patent: Apr. 6, 2010

(54) DEVELOPING DEVICE HAVING IMPROVED SEALING STRUCTURE

(75) Inventors: Seung-yoon Lee, Suwon-si (KR); Jeong-hun Pang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 278 days.

(21) Appl. No.: 11/585,140

(22) Filed: Oct. 24, 2006

(65) Prior Publication Data

US 2007/0134020 A1 Jun. 14, 2007

(30) Foreign Application Priority Data

Dec. 9, 2005 (KR) ..... 10-2005-0121128

(51) Int. Cl.
*G03G 15/00* (2006.01)

(52) U.S. Cl. ..... 399/103

(58) Field of Classification Search ..... 399/102, 399/103, 274, 284, 105
See application file for complete search history.

(56) References Cited

FOREIGN PATENT DOCUMENTS

| | | | |
|---|---|---|---|
| JP | 11-249425 | | 9/1999 |
| JP | 2000-0242079 | | 9/2000 |
| JP | 2001-022179 | | 1/2001 |
| JP | 2001022179 | A * | 1/2001 |
| JP | 2001-0060041 | | 3/2001 |
| JP | 2003-0270936 | | 9/2003 |
| JP | 2005-106914 | | 4/2005 |
| KR | 10-2003-0092320 | | 12/2003 |

OTHER PUBLICATIONS

Computer translation of JP2001-022179a.*

* cited by examiner

*Primary Examiner*—Quana M Grainger
(74) *Attorney, Agent, or Firm*—Roylance, Abrams, Berdo & Goodman, L.L.P.

(57) ABSTRACT

A developing device has a sealing unit that seals a gap between an inner wall of a housing that stores developer and a blade that controls a thickness of developer attached on a developing roller. The sealing unit of the developing device includes a first sealing member inserted into a gap between the inner wall of the housing and an end portion of the blade, a second sealing member placed on the blade to contact the first sealing member, and a pressing member that presses the first and second sealing members so as to prevent gaps between the first and second sealing members. Therefore, the gap between the blade and the inner wall of the housing can be blocked efficiently without damaging the developing roller, and a stable and efficient developing process can be performed.

12 Claims, 3 Drawing Sheets

DEVELOPING DEVICE HAVING IMPROVED SEALING STRUCTURE

CROSS-REFERENCE TO RELATED PATENT APPLICATIONS

This application claims the benefit under 35 U.S.C. §119 (a) of Korean Patent Application No. 10-2005-0121128, filed on Dec. 9, 2005, in the Korean Intellectual Property Office, the entire disclosure of which is hereby incorporated by reference.

BACKGROUND OF THE INVENTION

1. Field of the Invention

The present invention relates to a developing device for an electrophotographic image forming apparatus which develops an electrostatic latent image formed on a photosensitive medium using developer. More particularly, the present invention relates to a developing device having an improved sealing structure for preventing developer from leaking.

2. Description of the Related Art

Referring to FIG. 1, in an electrophotographic image forming apparatus such as a laser beam printer, an electrostatic latent image formed on a photosensitive medium 20 by a laser scanner 40 is developed into a visible image by a developing device 10 using developer, and then, the developer image is transferred onto a sheet of paper 1. That is, when the laser scanner 40 scans the laser onto a surface of the photosensitive medium 20 that is charged to a predetermined electric potential by a charger 30, the electric potential of the exposed surface is lowered and an electrostatic latent image is formed. Developer particles attached on a developing roller 11 of the developing device 10 are transferred onto the electrostatic latent image by an electric force to develop the image.

The developing device 10 includes an agitator 14 for agitating the developer in a housing 15 of the developing device 10 to electrically charge the developer by friction, a supplying roller 13 for supplying the charged developer onto a surface of the developing roller 11, and a blade 12 for controlling a thickness of the developer layer attached on the surface of the developing roller 11. Therefore, the developer particles charged by the agitator 14 are supplied to the surface of the developing roller 11 by the supplying roller 13, and the blade 12 maintains a constant thickness of developer attached on the developing roller 11. Then, the developer particles are attached onto the electrostatic latent image on the photosensitive medium 20 separated from the developing roller 11 by a developing gap (g). Bias voltages are applied to the supplying roller 13, the developing roller 11, and the photosensitive medium 20 for transferring the charged developer particles.

Referring to FIG. 2, a sealing member 16 for preventing the developer particles from leaking out is installed between the blade 12 and an inner wall 15*a* of the housing 15. That is, the sealing members 16 are installed on both end portions of the blade 12 to prevent the developer from leaking through a gap between the inner wall 15*a* of the housing 15 and the blade 12.

However, according to the above conventional sealing structure, the developer can leak out through the gap between the sealing member 16 and the blade 12. That is, the sealing member 16 is generally formed of a sponge, and even if the sponge 16 is adhered to both ends of the blade 12, the developer particles may leak through the small gap between the sponge 16 and the blade 12 after rotating the developing roller 11. If the attaching force of the sealing member 16 to the end portion of the blade 12 is increased, leakage of the developer may be prevented. However, in this case, the blade 12 may be curved, and thus may not maintain a constant thickness developer layer on the developing roller 11. In addition, in consideration of the above problem, the both end portions of the blade 12 may be formed of a material having high rigidity and the sealing member 16 may be strongly attached to the both end portions of the blade 12 to prevent the blade 12 from curving. However, in this case, the hard portions of the blade 12 that have a high rigidity may scratch the surface of the developing roller 11, and thus, the life span of the developing roller 11 may be shortened.

Therefore, there is a need for a sealing structure for a developing device that does not damage the developing roller and can prevent the developer from leaking out.

SUMMARY OF THE INVENTION

An aspect of the present invention is to address at least the above problems and/or disadvantages and to provide at least the advantages described below. Accordingly, an aspect of the present invention is to provide a developing device having an improved sealing structure that can effectively seal a gap between a blade and an inner wall of a housing to prevent developer from leaking out without affecting other characteristics of the developing device.

According to an aspect of the present invention, a developing device includes a housing containing developer, a developing roller for developing an electrostatic latent image using the developer in the housing, a blade for maintaining a substantially constant thickness of developer on the developing roller, and a sealing unit for preventing developer from leaking through gaps between the blade and an inner wall of the housing. The sealing unit includes a first sealing member inserted into a gap between the inner wall of the housing and an end portion of the blade, a second sealing member placed on the blade to contact the first sealing member, and a pressing member for pressing the first and second sealing members so as to prevent gaps between the first and second sealing members.

The first sealing member may surround a part of an end portion of the developing roller body.

The first sealing member and the second sealing member may be formed of a sponge. The pressing member may be a plate spring with a first end and a second end. The first end may be fixed on the housing and the second end of the plate spring may press the first and second sealing members.

The blade may be a trailing type blade that contacts the developing roller in a forward direction with respect to a rotation direction of the developing roller.

The blade may be a counter-trailing type blade that contacts the developing roller in a reverse direction with respect to a rotation direction of the developing roller.

According to another aspect of the present invention, a developing device comprises a housing for storing developer, a developing roller for developing an electrostatic latent image using developer stored in the housing, a blade for maintaining a substantially constant thickness of developer on the developing roller, the blade being disposed on the housing and forming gaps between the end portions of the blade and an inner wall of the housing, first sealing members disposed in the gaps between the end portions of the blade and an inner wall of the housing, second sealing members disposed on the blade and contacting the first sealing member, and pressing members for pressing the first and second sealing members together so that there are substantially no gaps between the first and second sealing members.

According to another aspect of the present invention, a sealing unit for preventing developer from leaking through a gap between a blade and an inner wall of a developer housing of a developing device comprises a first sealing member disposed in a gap between the inner wall of the housing and an end portion of the blade, a second sealing member disposed on the blade and contacting the first sealing member, and a pressing member that presses the first and second sealing members to block the gap between the first and second sealing members.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF THE INVENTION

The matters defined in the description such as a detailed construction and elements are provided to assist in a comprehensive understanding of the exemplary embodiments of the invention and are merely exemplary. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
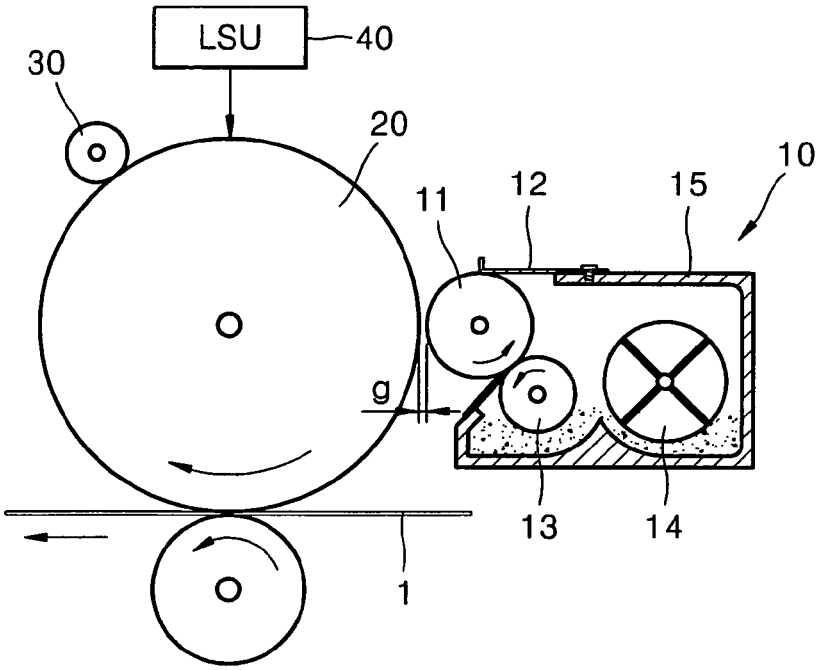
FIG. 1 (PRIOR ART)
FIG. 1 is a schematic cross-sectional view of a conventional developing device.
Figure 2:
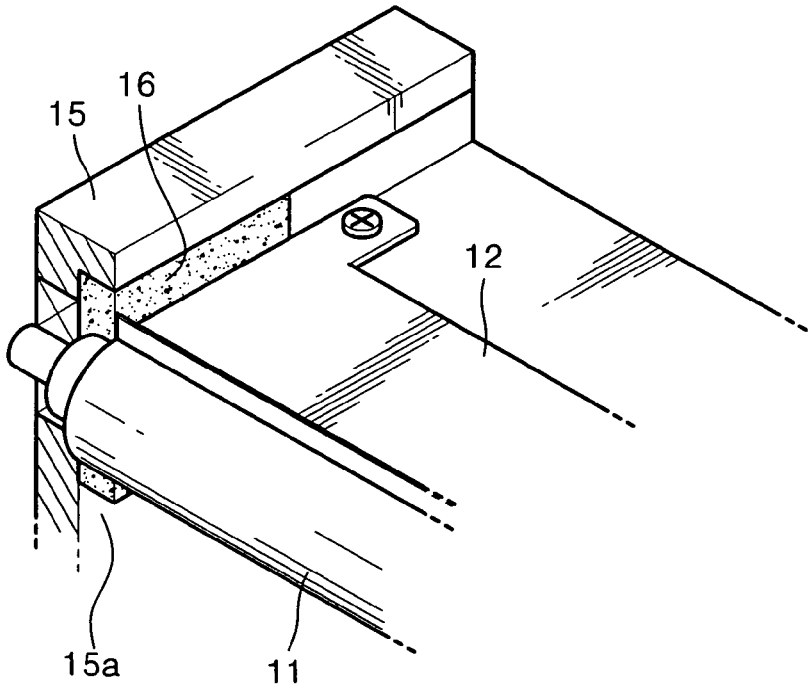
FIG. 2 (PRIOR ART)
FIG. 2 is an enlarged perspective view of a sealing unit used in the developing device of FIG. 1.
Figure 3:
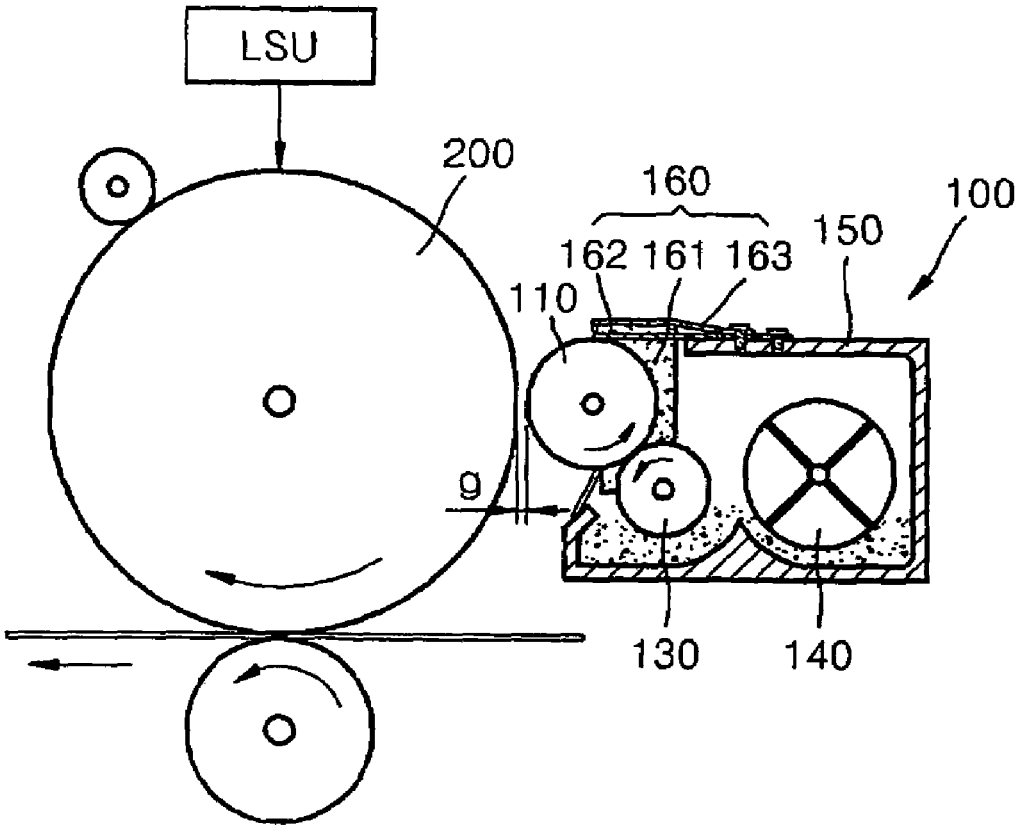
FIG. 3 is a cross-sectional view of a developing device including a sealing unit according to an exemplary embodiment of the present invention.

FIG. 3 illustrates a developing device 100 according to an exemplary embodiment of the present invention. Referring to FIG. 3, the developing device 100 includes a housing 150 that stores developer, a developing roller 110 that faces a photosensitive medium 200 with a developing gap g therebetween, and a blade 120 (see FIG. 4) that maintains a constant thickness of a developer layer attached to a surface of the developing roller 110. An agitator 140 agitates the developer in the housing 150 to electrically charge the developer, and a supplying roller 130 supplies the charged developer to the developing roller 110. Therefore, when the developing process is performed, developer particles charged by the agitator 140 are transferred onto the surface of the developing roller 110 through the supplying roller 130, and the blade 120 controls the thickness of the developer on the developing roller 110. After that, the developer particles are supplied to the developing gap g. The development is performed at the developing gap g, and the developer particles are attached onto an electrostatic latent image formed on the photosensitive medium 200 by an electric force to develop an electrostatic latent image into a visible image.

Figure 4:
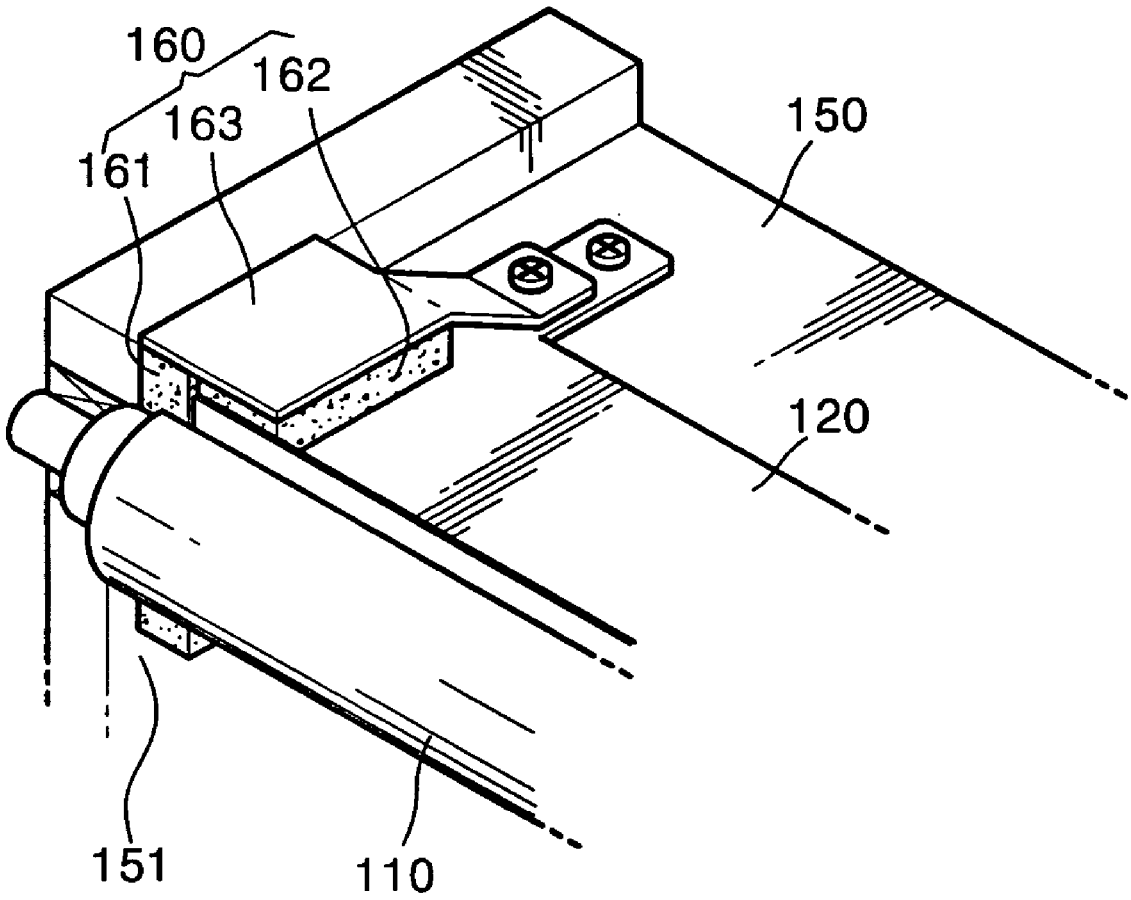
FIG. 4 is an enlarged perspective view of the sealing unit in the developing device of FIG. 3.

In addition, referring to FIGS. 3 and 4, a sealing unit 160 for preventing the developer in the housing 150 from leaking through a gap between the blade 120 and an inner wall 151 of the housing 150 includes two sealing members 161 and 162, and a pressing member 163 pressing the two sealing members 161 and 162 to seal the gap. The first sealing member 161 is inserted between the inner wall 151 of the housing 150 and an end portion of the blade 120 while surrounding half of the developing roller 110 at an end portion of the developing roller 110. The second sealing member 162 is placed on an upper end portion of the blade 120, and is adhered to the first sealing member 161. Therefore, the first sealing member 161 blocks a gap between the inner wall 151 of the housing 150 and the end portion of the blade 120, and the second sealing member 162 blocks a space from the end of the blade 120 to a predetermined upper portion of the blade 120. That is, since the two sealing members 161 and 162 are not only disposed in the gap between the inner wall 151 of the housing 150 and the end portion of the blade 120, but also can be disposed on an inner upper portion of the blade 120 to some degree, the gaps can be completely covered by the overlapping of the two sealing members 161 and 162. With this configuration, however, the developer may leak through the fine gap between the first and second sealing members 161 and 162. Thus, the pressing member 163 presses the two sealing members 161 and 162 together so that there is substantially no gap between them. The pressing member 163 is preferably a plate spring with a first end and a second end. The first end of is fixed on the housing 150 and the second, free end presses the first and second sealing members 161 and 162. Therefore, substantially no gap is formed by the first and second sealing members 161 and 162 because the pressing member 163 blocks the space from the inner wall 151 of the housing 150 to the upper end portion of the blade 120. Thus, the developer in the housing barely leaks out of the housing 150.

In addition, the first and second sealing members 161 and 162 are preferably formed of a sponge. Therefore, the first sealing member 161 formed of the sponge and the blade 120 contact the body of the developing roller 110, and thus, the developing roller 110 is not damaged. FIG. 4 illustrates one end portion of the blade 120—the other end of the blade 120 has a substantially symmetrical structure.

Meanwhile, the blade 120 of the present exemplary embodiment is a trailing type blade that contacts the developing roller 110 in a forward direction with respect to the rotation direction of the developing roller 110. A counter-trailing type blade that contacts the developing roller 110 in a reverse direction with respect to the rotation direction of the developing roller 110 can be used together with the sealing unit including the first and second sealing members 161 and 162 and the pressing member 163. According to the sealing unit of the present invention, the pressing member 163 presses the second sealing member 162 placed on the blade 120 toward the developing roller 110. Thus, the pressing member 163 can press the sealing members 161 and 162 stably from the outside of the housing 150 toward the inside of the housing 150 when a trailing type blade is used. If a counter trailing type blade is used, the pressing member 163 presses the first and second sealing members 161 and 162 from the inside of the housing 150 to the outside of the housing 150. The pressure may not be as stable with this configuration, however, and, thus, the sealing unit of the present exemplary embodiment may be more efficient when used in conjunction with a trailing type blade.

According to the developing device of the present invention, the gaps between the blade and the inner wall of the housing can be blocked efficiently without damaging the developer, and thus, stable and efficient developing process can be ensured.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing device comprising:

a housing to store developer;

a developing roller to develop an electrostatic latent image using developer from the housing;

a trailing type blade for maintaining a substantially constant thickness of developer on the developing roller, said blade being positioned on said housing and contacting the developing roller; and a sealing unit to prevent developer from leaking through gaps between the blade and an inner wall of the housing, the sealing unit comprising:

a first sealing member disposed in a gap between the inner wall of the housing and an end portion of the blade;

a second sealing member positioned on said housing and disposed on the blade and contacting the first sealing member; and a pressing member that presses the first and second sealing members to substantially block the gap between the first and second sealing members.

2. The developing device of claim 1, wherein the first sealing member surrounds a part of an end portion of the developing roller.

3. The developing device of claim 1, wherein the first sealing member and the second sealing member comprise sponges.

4. The developing device of claim 3, wherein the pressing member comprises a plate spring with a first end and a second end, the first end being fixed on the housing and the second end pressing the first and second sealing members.

5. A developing device comprising:

a housing to store developer;

a developing roller to develop an electrostatic latent image using the developer stored in the housing;

a trailing type blade that maintains a substantially constant thickness of developer on the developing roller, the blade being disposed on the housing and forming gaps between the end portions of the blade and an inner wall of the housing, said blade being positioned on said housing and contacting the developing roller;

first sealing members disposed in the gaps between the end portions of the blade and an inner wall of the housing;

second sealing members positioned on said housing and disposed on the blade and contacting the first sealing member; and pressing members to press the first and second sealing members together so that there are substantially no gaps between the first and second sealing members.

6. The developing device of claim 5, wherein the first sealing member surrounds a part of an end portion of the developing roller.

7. The developing device of claim 5, wherein the first sealing member and the second sealing member comprise sponges.

8. The developing device of claim 7, wherein the pressing member comprises a plate spring with a first end and a second end, the first end being fixed on the housing and the second end pressing the first and second sealing members.

9. A sealing unit to prevent developer from leaking through a gap between a trailing type blade and an inner wall of a developer housing of a developing device, the sealing unit comprising:

a first sealing member disposed in a gap between the inner wall of the housing and an end portion of the blade;

a second sealing member positioned on the developer housing and disposed on the blade and contacting the first sealing member; and a pressing member that presses the first and second sealing members to substantially block the gap between the first and second sealing members, wherein the blade is positioned on the developer housing and contacts the developing roller.

10. The developing device of claim 9, wherein the first sealing member surrounds a part of an end portion of a developing roller.

11. The developing device of claim 9, wherein the first sealing member and the second sealing member comprise sponges.

12. The developing device of claim 11, wherein the pressing member is a plate spring with a first end and a second end, the first end being fixed on the housing and the second end pressing the first and second sealing members.

* * * * *